US006054002A

United States Patent [19]

Griesbach, III et al.

[11] Patent Number: 6,054,002

[45] **Date of Patent: *Apr. 25, 2000**

[54] METHOD OF MAKING A SEAMLESS TUBULAR BAND

[75] Inventors: Henry Louis Griesbach, III, Atlanta; Philip Anthony Sasse, Alpharetta, both of Ga.

[73] Assignee: Kimberly-Clark Worldwide, Inc., Neenah, Wis.

[ * ] Notice: This patent issued on a continued prosecution application filed under 37 CFR 1.53(d), and is subject to the twenty year patent term provisions of 35 U.S.C. 154(a)(2).

[21] Appl. No.: 08/671,391

[22] Filed: Jun. 27, 1996

[51] Int. Cl.[7] ..... D01D 5/22

[52] U.S. Cl. ..... 156/167; 264/168; 264/171.11; 264/172.13; 264/172.14; 264/172.15; 156/173

[58] Field of Search ..... 156/167, 173; 264/168, 171.11, 172.14, 172.15, 172.13

[56] References Cited

U.S. PATENT DOCUMENTS

| | | | |
|---|---|---|---|
| 3,226,792 | 1/1966 | Starkie et al. | 28/1 |
| 3,551,271 | 12/1970 | Thomas et al. | 161/150 |
| 5,270,107 | 12/1993 | Gessner . | |
| 5,292,239 | 3/1994 | Zeldin et al. . | |
| 5,382,400 | 1/1995 | Pike et al. . | |
| 5,405,682 | 4/1995 | Shawver et al. | 428/221 |

FOREIGN PATENT DOCUMENTS

| | | | |
|---|---|---|---|
| 0 068 659 | 1/1983 | European Pat. Off. | D01D 5/30 |
| 1095147 | 12/1967 | United Kingdom | D01D 5/22 |
| 1 558 592 | 1/1980 | United Kingdom | D01F 6/28 |

OTHER PUBLICATIONS

Patent Abstracts of Japan/Pub. No. 07070825/Pub. Date Mar. 14, 1995.

Patent Abstracts of Japan/Pub. No. 57193521/Pub. Date Nov. 27, 1982.

*Primary Examiner*—Michael W. Ball

*Assistant Examiner*—Sam Chuan Yao

[57] ABSTRACT

Side-by-side conjugate filaments made from thermoplastic elastomers and spunbond-type polyolefins exhibit an extremely high propensity to self-crimp. At appropriate polymer ratios and processing conditions (with mechanical or aerodynamical drawing) the crimp develops spontaneously after relaxation of the attenuation force. The amount of crimp and the degree of elastic properties depend on the elastomer content and the processing conditions. The resulting crimp is typically in the range of 25–200 crimps per inch. This combination of exceptionally high crimp and an elastomer component imparts stretch and recovery properties. The filaments can be wrapped around a cylindrical supporting structure to create a continuous, seamless elastic band, useful for body-fit articles.

18 Claims, 1 Drawing Sheet

METHOD OF MAKING A SEAMLESS TUBULAR BAND

FIELD OF THE INVENTION

The present invention relates to a self-crimping conjugate filament formed upon release of an attenuation force applied to molten filaments produced by a melt attenuation apparatus. A continuous seamless band having improved stretch and recovery properties can be formed from the self-crimping filaments.

BACKGROUND OF THE INVENTION

Current methods for obtaining "body-fit" features in personal care products use mechanical fasteners, woven elastic band structures, elastic nonwoven laminates, or glued-in elastic strands. All have drawbacks to some degree when measured against the three criteria of cost, performance, and aesthetics. With respect to the elastic components, development of elastic nonwoven laminates (e.g., waist elastic, stretchable side panels, Lycra® strand laminates) has been leveraged in products to give body fit innovations with aspects of cloth-like aesthetics. These stretchable structures are fabricated in a "flat" or planar geometry. This form suits existing base sheet and product assembly technologies; however, it introduces complexities that require sophisticated solutions, especially in the converting process. The invention when used in the form of a seamless band or tubular structure provides an alternative to such flat structures.

Bicomponent filaments in a side-by-side configuration are defined as having a "conjugate" arrangement. Almost all synthetic conjugate fibers have self-crimp potential. The crimp, helical in structure, usually manifests itself in melt-spun filaments after they are subjected to a post-treatment that induces shrinkage in the components. (Commonly used treatments are heat, moisture, and neck-stretching.) The crimp-forming potential of conjugate fibers is primarily related to the difference in shrinkage characteristics of the individual components. The shrinkage results from internal structural changes that are triggered by temperature- and/or time-dependent phase changes (crystallization factors being most prevalent).

Processing conditions will not produce helical crimping without a shrinkage differential between the components. Even the crimp resulting from asymmetric quenching of polypropylene is due to a conjugate arrangement of different crystalline structures. However, they do impact the extent of crimp development. Because most self-crimping forces are low, they are usually overpowered by attenuation forces. As a result, most spun conjugate filaments exhibit no crimp. For certain component combinations, spinning conditions can be found that result in spontaneous crimping (once the drawing forces are relaxed) without the need of a post-treatment.

Crimp in a fiber causes greater bulk in fabric form, it changes the tactile properties (e.g., drape and feel), and it has the potential for imparting the additional feature of stretch. This is the case for both mechanically induced-crimped and self-crimped filaments. In self-crimped filaments the ability to stretch arises from their helical, spring-like structure, which is geometrically distinct from the "saw tooth" structure of mechanically crimped filaments. The stretch consists of both extension and recovery aspects. In extension, the crimped fiber shows a nonlinear, low stress response as the crimp geometry deforms, then a high stress response as the fiber is completely extended. Recovery, if it occurs after extension, is by crimp "regain."

Because their recovery is linked to crimp regain (a physical manifestation of relatively low internal forces) most conventional self-crimping fibers lack the power retraction of Lycra® and other purely elastic fibers. The power retraction of elastomers are a consequence of their molecular structure. Lycra®-like filaments (from dry-spun polyurethane), rubber strands, and thermoplastic elastomers (e.g. Kraton® polymers, Arnitel® polymers, melt-spun polyurethanes) are all segmented block copolymers. The elastic properties arise from alternating molecular sequences of soft chain segments bonded together with hard or rigid chain segments. In a relaxed state the soft chains lie in a tangled disorder; under tension the chains straighten out while always straining back to their natural tangle. While elastomeric fibers develop an immediate molecular resistance under tension, no such resistance occurs for crimped fibers until the crimp is pulled out and cold-drawing deformation begins.

Polyurethane-based fibers attenuated from the melt, as disclosed in the prior art, do not exhibit spontaneous elastomeric properties (recovery after stretch). Rather, these fibers must be aged for a period of time, some up to approximately twenty four hours, which increases significantly the cost and time to produce product. Additionally, post-formation treatment, e.g., stretching, is normally required. Polyurethane filaments are not known to crimp when attenuated from melt. See, for example, U.S. Pat. Nos. 3,379,811; 4,551,518; and 4,660,228.

U.S. Pat. No. 3,761,348, issued to Chamberlin, discloses a helically crimped biconjugate filament composed of a polyester and an elastomeric polyurethane. Once the filaments are formed (spun) they are aged and only then stretched via a post-spinning step to develop crimps. The required aging and post-spinning stretching step introduces additional time and expense into the manufacturing process.

U.S. Pat. No. 4,405,686, issued to Kuroda et al., discloses a highly stretchable crimped elastic filament resulting from the biconjugate combination of an elastomer and a non-elastomer having specified cross-sectional shapes (e.g., bilobal). The stretch capabilities of the filaments in the filament are described as having two states: a low elongation state where the stretch due to crimp is dominant and a high elongation state where the stretch due to the elastomer is dominant. As in Chamberlin, the spun filaments must be drawn in a subsequent step in order to develop the crimp that dominates the stretch characteristics at low elongations. Again, this separation of steps increases expense and time to produce product.

There is a need then, for a fiber composition that will produce self-crimping fibers absent post-treatment steps. Such a fiber would have high extensibility while exhibiting high recovery properties. Such a fiber could be used to impart form-fitting (body conforming) attributes to incontinent garments (e.g., diapers), hospital garments (gowns), bandages and body wraps as well as personal garments, where compressive force is needed, as well as in personal garments, such as underwear and the like.

It is a principal object of the present invention to provide melt attenuated conjugate filaments having improved crimping and extensibility properties without the need of a post-stretching or tensioning step.

It is a further object of the present invention to provide a method of forming melt attenuated conjugate filaments which can be immediately wrapped after melt attenuation to form a band having improved extensibility in the radial direction and a high degree of recovery.

Other objects, features, and advantages of the present invention will become apparent upon reading the following detailed description of embodiments of the invention, when taken in conjunction with the accompanying drawing and the appended claims.

SUMMARY OF THE INVENTION

The objects of the present invention are achieved by providing a novel "class" of self-crimping attenuated conjugate filaments and method of producing same that, unlike conventional crimped fibers, has exceptional extension and recovery attributes.

In a preferred embodiment a method of forming a filament generally comprises providing a first component being a polyolefin selected from the group consisting of polypropylenes, polyethylenes, and copolymers of polypropylene and polyethylene suitable for spunbond processing, and, providing a second component in the form of a nonpolyurethane, block copolymer thermoplastic elastomer, such as Kraton® or Arnitel® polymers or blends thereof. Each of the components is extruded separately and combined in a conjugate spin pack and passed through a spinneret to form the molten side-by-side conjugate filaments. The filaments are attenuated according to conventional techniques using either aspiration or mechanical drawing forces to produce side-by-side arranged conjugate filaments that spontaneously develop approximately 25 or more crimps per inch after relaxation of the attenuation force.

A side-by-side conjugate configuration of a spunbond-type polyolefin and a Kraton® polymer blend (e.g. containing 70–100% Kraton® 1659) or 100% Arnitel® thermoplastic elastomer (e.g. EM 400) produces an extremely crimped filament that exhibits a high degree of recovery after stretching. The crimp is helical in structure and occurs at a frequency of at least about 25 crimps per inch, and is typically 50–200 crimps per inch. Polymer composition and spinning conditions that favor spontaneous crimp development are: (1) The polyolefin component is suitable for spunbond applications, meaning its molecular weight distribution is narrow (i.e., Mw/Mn=~3.0–4.0) and it has similar Melt Flow (@ 230° C.) values (i.e., in the range of approximately 20–100 grams/10 minutes). Examples of such polyolefins are Exxon 3445 polypropylene and Dow ASPUN® 6811 A linear low density polyethylene. (2) The elastomeric component comprises about 25–80% of the filament. (3) The filaments are melt extruded through the spinneret at conditions of 0.7–1.3 grams per hole per minute ("GHM") and the molten filaments are attenuated via take-up speeds of 700–2500 meters per minute ("MPM").

These conjugate filaments extend up to 200% of their relaxed length at low levels of stress and they recover almost completely with little induced set. At elongations over 200% the filaments increasingly exhibit power stretch and retractive recovery attributes. This stretch behavior is attributed to the exceedingly high crimp development (allowing high extensions) and the elastomeric component (favoring retraction and crimp retention). This crimping was not seen in comparable trials with polyurethanes used as the elastomeric component. Additionally, these crimped, elastic filaments have aesthetically pleasing tactile characteristics. The crimp and the polypropylene (or polyethylene) diminish the rubber-like feel typical of elastomeric filaments.

The present invention provides for a continuous seamless elastic band made of highly crimped filaments made via a one-step process, i.e., directly from the melt attenuation step. These stretchable, body conforming structures are more closely related to the tubular form of knitted fabrics that resemble elastic wrist bands or knitted fabrics in tubular form than flat elastic nonwoven laminates. Fabrication of seamless band structures that exhibit excellent body conformance attributes are achieved by wrapping the melt-spun attenuated filaments formed as described above around a rotating cylinder that controls the take-up speed. When the band of wrapped filaments is removed from the cylinder its length contracts to a relaxed state by 60–80% (depending on spinning conditions).

These band structures exhibit the same extension and recovery attributes as the individual filaments. There is a tendency for these crimped filaments to bundle into a yarn-like structure that imparts a degree of structural integrity to the band so that it can be repeatedly stretched without separating into individual filaments.

BRIEF DESCRIPTION OF THE DRAWINGS

The invention is illustrated in the drawings in which like reference characters designate the same or similar parts throughout the figures of which.

DETAILED DESCRIPTION

Figure 1:
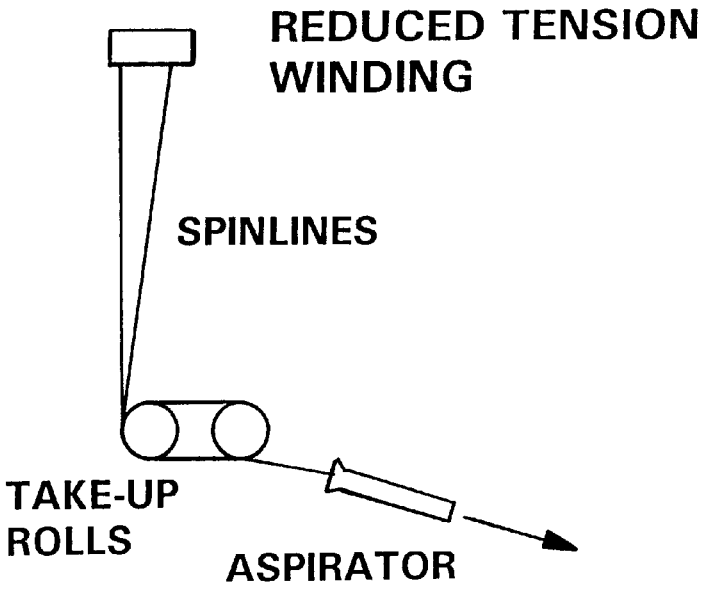
FIG. 1 shows a schematic drawing of a melt attenuation apparatus with an aspirating device to immediately relax the attenuation forces.

As used herein the term "conjugate fibers" refers to fibers which have been formed from at least two polymers extruded from separate extruders but combined together to form one fiber. Conjugate fibers are also sometimes referred to as multicomponent or bicomponent fibers. The polymers are usually different from each other, although conjugate fibers may be monocomponent fibers. The polymers are arranged in substantially constantly positioned distinct zones across the cross-section of the conjugate fibers and extend continuously along the length of the conjugate fibers. The configuration of such a conjugate fiber may be, for example, a sheath/core arrangement wherein one polymer is surrounded by another or may be a side by side arrangement or an "islands in the sea" arrangement. Conjugate fibers are taught in U.S. Pat. No. 5,108,820 to Kaneko et al., U.S. Pat. No. 4,795,668 to Krueger, and U.S. Pat. No. 5,336,552 to Strack et al. Conjugate fibers are also taught in U.S. Pat. No. 5,382,400 to Pike et al. and may be used to produce crimp in the filaments by using the differential rates of expansion and contraction of the two (or more) polymers. Crimped fibers may also be produced by mechanical means and by the process of German Patent DT 25 13 251 Al. For two component fibers, the polymers may be present in ratios of 75/25, 50/50/ 25/75 or any other desired ratios. The fibers may also have shapes such as those described in U.S. Pat. No. 5,277,976 to Hogle et al., U.S. Pat. No. 5,466,410 to Hills and U.S. Pat. Nos. 5,069,970 and 5,057,368 to Largman et al., which describe fibers with unconventional shapes. As used herein the term "blend" means a mixture of two or more polymers.

As used herein, "ultrasonic bonding" means a process performed, for example, by passing the fabric between a sonic horn and anvil roll as illustrated in U.S. Pat. No. 374,888, issued to Bornslaeger.

As used herein, the terms "elastic" and "elastomeric" when referring to a filament, film or fabric mean a material which upon application of a biasing force, is stretchable to a stretched, biased length which is at least about 150 percent, or one and a half times, its relaxed, unstretched length, and which will recover at least 50 percent of its elongation upon release of the stretching, biasing force.

As used herein the term "recover" refers to a contraction of a stretched material upon termination of a biasing force following stretching of the material by application of the biasing force. For example, if a material having a relaxed, unbiased length of one (1) inch was elongated 50 percent by stretching to a length of one and one half (1.5) inches the material would have a stretched length that is 150 percent of its relaxed length. If this exemplary stretched material contracted, that is recovered to a length of one and one tenth (1.1) inches after release of the biasing and stretching force, the material would have recovered 80 percent (0.4 inch) of its elongation.

Generally described, the present invention provides a method of forming a side-by-side conjugate filament from a first component and a second component, by melting each component, combining them to form molten filaments each with a side-by-side configuration and then attenuating the molten filaments as they solidify. Self-crimping of the filaments occurs upon relaxation of the attenuation force.

The first component is a polyolefin. In a preferred embodiment polypropylene, polyethylene or a copolymer of propylene and/or ethylene is employed. A preferred polypropylene is available as Exxon PD 3445 polypropylene (hereinafter sometimes referred to as "PP"), available from Exxon Chemical Company, Houston, Texas. It was also found that blending the Exxon PD 3445 with a lower viscosity polypropylene typically used for meltblowing applications, such as Montell PF 015 polypropylene (hereinafter sometimes referred to as "Montell PD 015"), available from Montell Chemical, Wilmington, Delaware, where the Exxon PD 3445 was present in a range of approximately 50–100%, more preferably approximately 66%, provided an acceptable mix. It was found that 100% Exxon PD 3445 provided a higher quality result than using a blend of polypropylene resins of narrow molecular weight distributions with lower melt viscosities, e.g., MF (at 230° C.) is greater than about 35 grams/10 minutes. It is to be understood, however, that for certain purposes such a blend can be employed. Where a copolymer of propylene and ethylene is used, the ethylene content is present in a concentration of approximately 7% or less and approximately 93% or more propylene.

The second component is a thermoplastic elastomer polymer made from block copolymers such as, copolyesters, polyamide polyether block copolymers, block copolymers having the general formula A-B-A' or A-B like copoly (styrene/ethylene-butylene), styrene-poly(ethylene-propylene)-styrene, styrene-poly(ethylene-butylene)-styrene, (polystyrene/ poly(ethylene-butylene)/polystyrene, poly(styrene/ethylene-butylene/styrene) and the like. Optionally, a flow modifier, as described here in below, can be used to adjust viscosity when combining with low viscosity polyolefins.

Useful thermoplastic elastomer polymers include block copolymers having the general formula A-B-A' or A-B, where A and A' are each a polymer end block which contains a styrenic moiety such as a poly (vinyl arene) and where B is an elastomeric polymer midblock such as a conjugated diene or a lower alkene polymer. Block copolymers of the A-B-A' type can have different or the same thermoplastic block polymers for the A and A' blocks, and the present block copolymers are intended to embrace linear, branched and radial block copolymers. In this regard, the radial block copolymers may be designated (A-B)m-X, wherein X is a polyfunctional atom or molecule and in which each (A-B)m-radiates from X in a way that A is an end block. In the radial block copolymer, X may be an organic or inorganic polyfunctional atom or molecule and m is an integer having the same value as the functional group originally present in X. It is usually at least 3, and is frequently 4 or 5, but not limited thereto. Thus, in the present invention, the expression "block copolymer", and particularly "A-B-A'" and "A-B" block copolymer, is intended to embrace all block copolymers having such rubbery blocks and thermoplastic blocks as discussed above, which can be extruded (e.g., into filaments), and without limitation as to the number of blocks. Commercial examples of such elastomeric copolymers are those known as Kraton® materials which are available from Shell Chemical Company of Houston, Texas. Kraton®block copolymers are available in several different formulations, a number of which are identified in U.S. Pat. Nos. 4,663,220 and 5,304,599, hereby incorporated by reference. Polymers composed of an elastomeric A-B-A-B tetrablock copolymer may also be used in the practice of this invention. Such polymers are discussed in U.S. Pat. No. 5,332,613 to Taylor et al. In such polymers, A is a thermoplastic polymer block and B is an isoprene monomer unit hydrogenated to a substantially poly(ethylene-propylene) monomer unit. An example of such a tetrablock copolymer is a styrene-poly(ethylene-propylene)-styrene-poly (ehtylene-propylene) or SEPSEP elastomeric block copolymer, available from the Shell Chemical Company of Houston, Texas under the trade designation Kraton® G-1659.

Another suitable material is a polyester block amide copolymer having the formula:

$$HO\text{--}\left[\underset{\underset{O}{\|}}{C}\text{---}PA\text{---}\underset{\underset{O}{\|}}{C}\text{---}O\text{---}PE\text{---}O\right]_n\text{-}H$$

where n is a positive integer, PA represents a polyamide polymer segment and PE represents a polyether polymer segment. In particular, the polyether block amide copolymer has a melting point of from about 150° C. to about 170° C., as measured in accordance with ASTM D-789; a melt index of from about 6 grams per 10 minutes to about 25 grams per 10 minutes, as measured in accordance with ASTM D-1238, condition Q (235 C/1 Kg load); a modulus of elasticity in flexure of from about 20 Mpa to about 200 Mpa, as measured in accordance with ASTM D-790; a tensile strength at break of from about 29 Mpa to about 33 Mpa as measured in accordance with ASTM D-638 and an ultimate elongation at break of from about 500 percent to about 700 percent as measured by ASTM D-638. A particular embodiment of the polyether block amide copolymer has a melting point of about 152° C. as measured in accordance with ASTM D-789; a melt index of about 7 grams per 10 minutes, as measured in accordance with ASTM D-1238, condition Q (235 C/1 Kg load); a modulus of elasticity in flexure of about 29.50 Mpa, as measured in accordance with ASTM D-790; a tensile strength at break of about 29 Mpa, a measured in accordance with ASTM D-639; and an elongation at break of about 650 percent as measured in accordance with ASTM D-638. Such materials are available in various grades under the trade designation PEBAX® from Atochem Inc. Polymers Division (RILSAN®), of Glen Rock, N.J. Examples of the use of such polymers may be found in U.S. Pat. Nos. 4,724,184, 4,820,572 and 4,923,742 hereby incorporated by reference, to Killian et al. and assigned to the same assignee as this invention.

A preferred elastomer was blend of Kraton® 1659 and Quantum NA-601-04 LDPE (low density polyethylene, used here as a processing aid for flow adjustment), available from Quantum Chemical, of Cincinnati, Ohio. A preferred ratio was 70% Kraton® 1659 and 30% Quantum® NA-601-04. The usable range was approximately 50–100% Kraton® 1659.

Thermoplastic copolyester elastomers can be used in the practice of the invention. The thermoplastic block copolyester elastomers include copolyetheresters having the general formula:

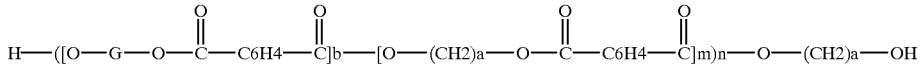

where "G" is selected from the group consisting of poly (oxyethylene)-alpha,omega-diol, poly(oxypropylene)-alpha, omega-diol, poly(oxytetramethylene)-alpha,omega-diol and "a" and "b" are positive integers including 2, 4 and 6, "m" and "n" are positive integers including 1–20. Such materials generally have an elongation at break of from about 600 percent to 750 percent when measured in accordance with ASTM D-638 and a melt point of from about 350° F. to about 400° F. (176° C. to 205° C.) when measured in accordance with ASTM D-2117.

Commercial examples of such copolyester materials are, for example, those known as Arnitel® copolyetherester, formerly available from Akzo Plastics of Arnhem, Holland and now available from DSM of Sittard, Holland, or those known as Hytrel® which are available from E.I. duPont de Nemours of Wilmington, Delaware. Formation of an elastomeric nonwoven web from polyester elastomeric materials is disclosed in, for example, U.S. Pat. No. 4,741,949 to Morman et al. and U.S. Pat. No. 4,707,398 to Boggs, hereby incorporated by reference. However, the Arnitel® copolyetherester blend was found to yield less crimping per inch than the Kraton® polyethylene/Quantum® NA-601-04 LPDE blend. An optimum concentration of about 70% Arnitel® copolyetherester in combination with 30% polyolefin component yielded the highest crimp, while 80% Arnitel® copolyetherester content was the maximum obtained with noticeably less crimp than with 70% Arnitel® copolyetherester. 100% Arnitel® copolyetherester filaments exhibited no crimp.

It was found that polyurethanes substituted in for the elastomeric component and attenuated into filaments in combination with polypropylene or polyethylene did not spontaneously crimp and were unusable in the present invention.

The melt attenuation process where molten filaments are attenuated while they solidify is known to those of ordinary skill in the art and a detailed discussion is unnecessary. U.S. Pat. No. 3,849,241 presents a detailed disclosure of a melt attenuation process, and is incorporated by reference herein. Briefly, the first and second polymer components are melted separately and fed separately via metering pumps, and combined in a conjugate spin pack arrangement that includes a spinneret having an array of capillaries. Filaments formed are in a molten state when they exit the spinneret.

The formed molten filaments can be attenuated by aspiration or by mechanical drawing means, known to those skilled in the art. In examples of the present invention, the formed filaments were attenuated through a Lurgi gun (see U.S. Pat. Nos. 3,502,763 and 3,542,615 issued to Hartman) or other aspirating device, known to those skilled in the art, depending on the composition of the filaments and the desired denier and preferably attenuated by wrapping the filaments around a rotating cylinder at speeds of approximately 400–2500 MPM. Preferably the ratios of the final filament attenuation speed, measured in meters/minute, to the extrusion rate through the spinneret, measured in grams/hole/minute, of at least 1100. The filaments formed at these ratios are approximately 3–6 denier.

Relaxation of the tension after drawing the molten filaments is essential for crimp development. FIG. 1 shows a method for attenuating the molten filaments allowing for the relaxation of the attenuation forces so that there is minimal tension on the filaments.

Thermal testing of untensioned filaments in filament form showed no or little diminishment of the crimp up to approximately 55° C. (131 ° F).

Figure 2:
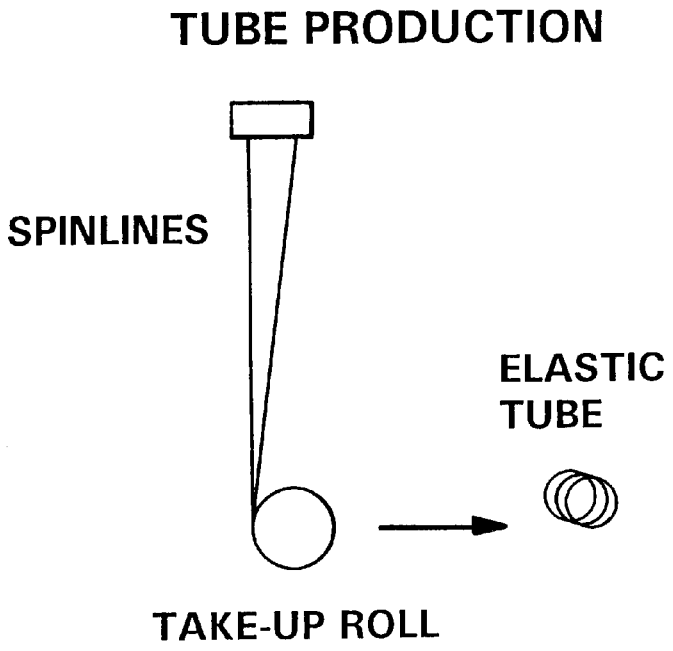
FIG. 2 shows a schematic drawing of a band forming apparatus.

In order to make the bands of the present invention, the filaments are wrapped around a take-up device, such as a rotating cylinder or roll, supported at one end of the axle, as shown in FIG. 2. Removing the wrap, either by stopping the take-up roll from rotating or by pushing the band off the rotating cylinder, resulted in a continuous band-like structure that contracted as soon as it was removed from the take-up roll. This represents a contraction of at least about 60% of the band's original as-spun wrapped circumference around the take-up device. (This is the same contraction as occurs in the melt attenuated filaments after relaxation of the attenuation forces.) This structure stretches and recovers radially. The circumference of the take-up roll is a significant factor in determining the size of the band; depending on the size of the take-up roll the resulting band could be used to form cuffs, sleeves, leggings, waistbands, and the like.

Spot bonding of the band to impart greater integrity can be achieved by any of several techniques known to those of ordinary skill in the art. Such techniques include, but are not limited to, thermal, ultrasonic, and adhesive bonding. It is easiest to do this prior to removing the band from the cylinder.

An important aspect of the present invention is that the novel combination of starting components produce a filament that self-crimps. Also important is that this crimping occurs during the filament formation process, as the attenuation force is released. Spontaneous crimping exhibited by the present invention occurs within approximately one minute after release of the attenuation force. Prior art crimped filaments, e.g., those of Chamberlin and Kuroda, required a separate post-attenuation treatment and/or aging step, or, at minimum, a period of time subsequent to filament formation. Much of the crimped fibers available use mechanical means for introducing the crimp. The present invention requires no separate aging step, but produces self-crimping fibers that exhibit high crimp density, helical crimps, and stretch and recovery characteristics improved over prior art filaments.

An advantageous feature of having the filaments in a continuous band form is that the accumulated retractive forces of the individual filaments increasingly resist extension towards the "as-wound" length (equal to the take-up cylinder circumference). This mimics power stretch properties typically encountered with Lycra® and other filaments made from 100% elastomeric components.

A further advantage is that the filaments produced by the present invention show potential in being thermally bondable to nonwovens containing a similar polyolefin component. This ability is important in connecting the filaments into a finished product as such products usually contain other components made from polyolefins and eliminates the need and cost of application of an adhesive.

The invention will be further described in connection with the following examples, which are set forth for purposes of illustration only. Parts and percentages appearing in the above description and such examples are by weight unless otherwise stipulated.

EXAMPLES

Example 1

This example used two extruders connected to a side-by-side conjugate spin pack arrangement with a polypropylene as the first component and the second component consisting of an elastomeric blend made from 70% Kraton® 1659+30% Quantum Chemical's NA-601-04 LDPE, low density polyethylene added for flow modification. (Subsequent references to Kraton® blends in these Examples refer to this blend.) The polypropylene (PP blend) had a low viscosity and consisted of a blend of approximately 66% Exxon's PD 3445 (appropriate for spunbond applications) and 33% Montell PF 015 (appropriate for meltblown applications). At 1.25 GHM, filaments were melt attenuated at a 35% Kraton® blend/65% polypropylene component ratio. Extremely high crimped filaments resulted when drawn through an air aspirating device used for melt attenuating spunbond filaments (such as a Lurgi gun device). Filaments melt attenuated at 100–170 PSI gun pressures, which imparted solidified filament speeds of approximately 2000–2900 MPM, were bundled into a filament that exhibited unusual stretch and recovery attributes. The crimp for these Kraton® blend and polypropylene side-by-side filaments was distinctly different from that obtained with similarly arranged polypropylene and polyethylene components. The helical crimp was much tighter than any previously observed for a purely melt attenuated filament, with or without post-drawing steps.

Measurements conducted on this filament structure yielded the following values:

Filament Bundle=11–14 filaments

Crimp Frequency=60–70 crimps/inch

Filament diameter=25–28 microns

Peak Load=21.3 gm

Peak Elongation=1146%

Prior to these conjugate filaments, the highest crimp spontaneously formed in spunbond filaments was 20 crimps/inch, with more typical values being 5–10 crimps/inch (for polypropylene/polyethylene conjugate filaments in a side-by-side arrangement or asymmetrically quenched polypropylene). Peak elongations for polypropylene or polypropylene/polyethylene side-by-side filaments of similar diameter were 150–300%. Therefore, the high peak elongation value was reasoned to be a consequence of the linear contraction of the filaments due to formation of the high crimp.

Table 1 compares filaments representative of the invention which were melt attenuated using spunbond techniques (high velocity air to impart the melt attenuation forces and high final filament speeds) to other, more typical side-by-side conjugate filaments processed in the same manner:

TABLE 1

Crimp For Filaments Made With Spunbond Melt Attenuation Methods
For side-by-side filaments with non-elastic components:

| Component A | Component B | % of fiber A/B | Total GHM | Max. Speed (MPM) | Filament Crimps/in |
|---|---|---|---|---|---|
| polypropylene | PP with 4% $TiO_2$ | 50/50 | 0.7 | 2040 | 15 |
| PP | polyethylene | 50/50 | 0.7 | 2040 | 7+/−1 |
| PP | PE | 50/50 | 0.7 | 3180 | 15+/−3 |
| For the present invention: | | | | | |
| Kraton ® Blend | PP blend | 35/65 | 1.25 | 2900 | 65+/−5 |

Example 2

For this and subsequent Examples, trials were conducted using conjugate extrusion/spin pack equipment to form the molten filaments and a mechanical take-up device for imparting attenuation to the molten filaments. The conjugate extrusion/spin pack equipment consisted of:

Two 1.25" diameter extruders each with L/D=24/1

Side-by-side round hole spin pack

Spin packs having 108, 144, or 288 capillaries per spin pack

Extrusion/piping temperatures=400–420° F.

Quench air cross flow velocity=~60 FPM

Component Description: The Kraton® blend elastomeric (second) component was 70% Kraton® 1659+30% Quantum's NA- 601-04 LDPE (blended and pelletized via a twin-screw pelletizing system). Low viscosity polypropylenes and polypropylene blends, prepared via a twin screw pelletizing system, were used as the other (first) component. These polypropylenes were Exxon PD 3445 ("PP") or blends made from Exxon PD 3445 and Montell PF 015 at 66/33 ("PP2"), and 50/50 ("PP1") ratios. A check of the position of the components in unattenuated filaments via a cross-section analysis showed all the polypropylene components to have wrapped around the Kraton® blend component. This means that the Kraton® blend has a higher viscosity than the polypropylenes.

Spontaneous Crimp Development: These conjugate filaments were melt attenuated by forming a single wrap of the spinlines around the rotating cylinder of the mechanical device and diverting them with an aspirating device to a collection bin. This method immediately relaxed the attenuation forces imparted by the mechanical take-up device on the filaments. These filaments exhibited the same high degree of crimp as the crimped filaments made in Example 1. Different take-up speeds were used at two throughputs to determine how these factors influenced the crimp. A qualitative assessment of crimp resulting from various conditions is given in Table 2:

TABLE 2

Melt-spun Conjugate Filaments of 40% Kraton ® Blend and 60% PP 2 (66% Exxon PD 3445 + 33% Montell PF 015)

| Total GHM | Take-up MPM | Spontaneous Crimp |
|---|---|---|
| 1.3 | 1000 | low |
| 1.3 | 1500 | high |
| 1.3 | 2000 | very high |

TABLE 2-continued

Melt-spun Conjugate Filaments of 40% Kraton ® Blend and 60% PP 2 (66% Exxon PD 3445 + 33% Montell PF 015)

| Total GHM | Take-up MPM | Spontaneous Crimp |
|---|---|---|
| 1.0 | 1200 | moderate |
| 1.0 | 1500 | high |
| 1.0 | 2000 | very high |

The same method of melt attenuation with a mechanical take-up device followed by immediate relaxation of those attenuation forces was used with 100% Exxon PD 3445 as the polypropylene component (at same component ratio) gave crimp at all of the above conditions. Crimp values of these aspirated filaments were later measured to range from 29 to 47 crimps/inch.

Example 3

Elastic Band Formation With Kraton® Blends As The Elastomeric Component

Filaments of the present invention using Kraton® blends as the elastomeric component in combination with polypropylene or polyethylene components were allowed to form multiple wraps on the take-up device in the following manner in order to make a seamless band. A 30 inch (76 cm) circumference take-up roll was used. The roll was supported at one end of the axle leaving the opposing end open so that the band could be removed from the roll. The cylinder was operated over a take-up speed range of 444–2500 MPM and the conjugate filaments of the two components were extruded over a range of 0.75–1.3 GHM as specified in Table 3.

Removing the band by stopping the take-up device and slipping the band off the "open" end of cylinder resulted in contraction of the wrapped filaments. The extent of contraction is shown in Table 3. The radial contraction of the band is caused by the crimping of the filaments. A simplified scenario for making such tube- or band-like structures is shown in FIG. 2.

Example 4

Elastic Band Formation With Arnitel® EM 400 As The Elastomeric Component

Arnitel® EM 400 polyetherester (Arnitel®) was substituted for the Kraton® in Example 6 for the elastomeric component in the conjugate filaments at the same ratios as the Kraton® blend component and melt attenuating at take-up speeds and throughputs as set forth in Table 3.

TABLE 3

Crimp and Band Contraction With Non-polyurethane Elastomeric Components

| Sample | Total GHM | Take-up Speed, MPM | Crimps/ Inch | % band Contraction |
|---|---|---|---|---|
| EXAMPLE 3: | | | | |
| 40% Kraton ® blend/60% PP | 1.3 | 800 | 29 ± 5 | not measured |
| | 1.3 | 2000 | 47 ± 10 | not measured |
| | 1.0 | 1500 | 27 ± 5 | not measured |
| | 1.0 | 2000 | 47 ± 15 | not measured |
| 50% Kraton ® blend/50% PP | 1.3 | 2000 | 131 ± 54 | not measured |
| 70% Kraton ® blend/30% PP | 1.3 | 2500 | 167 ± 18 | 79 |
| 80% Kraton ® blend/20% PP | 1.3 | 2500 | 119 ± 24 | not measured |

TABLE 3-continued

Crimp and Band Contraction With Non-polyurethane Elastomeric Components

| Sample | Total GHM | Take-up Speed, MPM | Crimps/ Inch | % band Contraction |
|---|---|---|---|---|
| 70% Kraton ® blend/30% PP | 0.75 | 444 | 34 ± 0 | not measured |
| | 0.75 | 900 | 116 ± 24 | 71 |
| | 0.75 | 1500 | 190 ± 41 | 73 |
| | 0.75 | 2000 | 207 ± 23 | 74 |
| 80% Kraton ® blend/20% PP | 0.75 | 2000 | 226 ± 31 | 79 |
| 70% Kraton ® blend/30% PE | 0.75 | 1200 | 40 ± 12 | 67 |
| EXAMPLE 4: | | | | |
| 70% Arnitel ® /30% PP | 1.3 | 1000 | 0 ± 0 | 0 |
| | 1.3 | 1500 | 18 ± 5 | 77 |
| | 1.3 | 2000 | 20 ± 2 | 74 |
| 55% Arnitel ®/45% PP | 1.3 | 1500 | 12 ± 3 | 79 |
| | 1.3 | 2000 | 31 ± 8 | 77 |
| | 1.3 | 2500 | 35 ± 6 | 74 |
| 70% Arnitel ®/30% PP | 0.75 | 700 | 17 ± 14 | 30 |
| | 0.75 | 1000 | 31 ± 6 | 61 |
| | 0.75 | 1500 | 50 ± 10 | 66 |
| | 0.75 | 2000 | 59 ± 6 | 71 |
| | 0.75 | 2500 | 68 ± 11 | 70 |
| 50% Arnitel/50% PE | 0.75 | 2500 | 65 ± 7 | 75 |
| 70% Arnitel ®/30% PE | 0.75 | 1500 | 8 ± 4 | 19 |
| | 0.75 | 2000 | 47 ± 9 | 70 |
| | 0.75 | 2500 | 59 ± 19 | 75 |
| 80% Arnitel ®/20% PE | 0.75 | 2000 | 20 ± 2 | 48 |
| | 0.75 | 2500 | 45 ± 14 | 75 |

[Kraton ® blend means a blend of 70 wt % Kraton ϕ 1659 and 30 wt % Quantum NA-601-04.]

Examples 5–9 involve conjugate polymer combinations that are more typical of self-crimping filaments, conjugate polymers where one component is a polyurethane, or monocomponent filaments of elastomeric polymers. The filaments from these polymers do not produce the same filament crimp and/or contraction as the invention.

Example 5

Lack Of Crimp With 20 Melt Flow Polypropylene

To determine the sensitivity of crimp development due to polypropylene type, a 20 Melt Flow fiber grade (Shell 5E38) was substituted for the low viscosity polypropylenes and combined with the Kraton® blend. A maximum draw speed of 1250 MPM was obtainable at 0.75 GHM for 40/60 and 30/70 ratios of the Kraton® blend and 20 Melt Flow polypropylene components, respectively. No crimp developed for these filaments using the method of melt attenuation followed by immediate relaxation of the attenuation forces. Table 4 sets forth the melt attenuation and crimp results. The 20 Melt Flow polypropylene's viscosity was greater than that of the Kraton® blend as shown in cross-sectional photomicrographs where the Kraton® polypropylene blend component wrapped around the 20 MF polypropylene component.

Example 6

Self-crimping Polypropylene Filaments

Self-crimping polypropylene filaments were made from dissimilar grades using the same side-by-side configuration. The polypropylene components were the 20 Melt Flow resin and the PP 2 or PP 1 polypropylene blends (50/50 or 66/33 Exxon PD 3445 and Montell PF 015, respectively). At a 50/50 component ratio, higher cross flow quench air settings, 1.3 GHM, and a draw speed of 1500 MPM, the crimp after melt attenuation and immediate relaxation was insignificant compared to that of the Kraton® blend/low viscosity polypropylene filaments of the invention. Melt attenuation of the filaments with the 20 MF polypropylene component above 1700 MPM encountered spinline breaks. Table 4 lists these melt attenuation conditions and the resulting low crimp.

TABLE 4

Melt-spun Conjugate Filaments of Other Components

| Filament Composition | Total GHM | Take-up MPM | Crimps/inch |
|---|---|---|---|
| EXAMPLE 5: | | | |
| 40% Kraton ® /60% 20 MF PP | 0.75 | 1250 | 0 |
| 30% Kraton ® /70% 20 MF PP | 0.75 | 1250 | 0 |
| EXAMPLE 6: | | | |
| 50% 20 MF PP/50% PP1 | 1.3 | 1500 | 7 |
| 50% 20 MF PP/50% PP2 | 1.3 | 1500 | <7 |

(PP 1 & 2 = 50/50 & 66/33 blend of PD 3445 and PF 015 respectively)

Example 7

Filaments of 100% Elastomeric Component

Filaments made from 100% Kraton® blend, Arnitel®, or polyurehane (Pellethane®) elastomers were melt attenuated and formed into bands according to the method described in EXAMPLE 4. Table 5 specifies the melt attenuation conditions and lists the lack of crimp development for these elastomers. Contraction of the filaments in band form was less than measured for filaments of the invention when made at comparable melt attenuation conditions.

TABLE 5

Crimp and Band Contraction With Elastomeric Component

| Sample | Total GHM | Take-up Speed, MPM | Crimps/ Inch | % Contraction |
|---|---|---|---|---|
| A. Pellethane ® Polyurethane | 0.75 | 1000 | 0 | 3 |
| | 0.75 | 2000 | 0 | 34 |
| B. 100% Kraton ® Blend | 0.85 | 435 | 0 | not measured |
| C. 100% Arnitel ® | 0.75 | 2500 | 0 | 19 |

Melt-attenuating filaments from 100% Kraton® polypropylene blend encountered a draw speed maximum of 435 MPM at 0.85 GHM. Higher draw speeds caused an increasing number of filament breaks in the spinline. The use of the Arnitel® elastomer produced spinlines with no filament breaks over the range of melt attenuation conditions tried (e.g. 2500 MPM maximum).

Filaments of 100% polyurethane (Pellethane®), spun at 1000 and 2000 MPM, showed no crimp or elastomeric attributes. In keeping with the aging needs of TPUs, recoverable stretch attributes did develop with time.

Example 8

Conjugate Filaments Using No Elastomeric Components

Non-elastic band structures were made from polypropylene (Exxon PD 3445) and polyethylene (Dow's ASPUN® 6811A) conjugate filaments at various component ratios and take-up speeds. Samples were made at a polypropylene content of 30%, 50%, and 70% and over a range of take-up speeds from 700 to 2000 MPM. The crimp that spontaneously formed in these filaments was substantially less than that observed with the use of an elastomeric component. The most crimp, ~6 crimps/inch, occurred at the 700 MPM draw speed and decreased as the speed increased (with <1 crimp/inch at 2000 MPM). Table 6 shows values for crimp and band contraction.

TABLE 6

Crimp and Band Contraction For Filaments of Polypropylene And Polyethylene

| Sample | Total GHM | Take-up Speed, MPM | Crimps/ Inch | % Contraction |
|---|---|---|---|---|
| 30% PP/70% PE | 0.75 | 1000 | 6 ± 0.3 | 42 |
| | 0.75 | 1500 | 3 ± 0.2 | 8 |
| 50% PP/50% PE | 0.75 | 700 | 5 ± 0.2 | 0 |
| | 0.75 | 1000 | 6 ± 0.4 | 61 |
| | 0.75 | 1500 | 5 ± 0.1 | 21 |
| | 0.75 | 2000 | 2 ± 0.5 | −5 (expands) |
| 70% PP/30% PE | 0.75 | 700 | 5 ± 0.3 | 48 |
| | 0.75 | 1000 | 4 ± 0.5 | 48 |
| | 0.75 | 1500 | 2 ± 0.2 | 2 |
| | 0.75 | 2000 | 1±0.1 | −5 (expands) |

Example 9

Conjugate Filaments Made Using Polyurethane As The Elastomeric Component

This example evaluated polyurethanes (TPUs) for the elastomeric component in combination with polypropylene or polyethylene components. A throughput of 0.75 ghm was maintained for all samples. A polyurethane (58887 from B.F. Goodrich) was used as the elastomeric component and melt attenuated into filaments in combination with polypropylene. No spinning problems were encountered at 70% or 80% polyurethane content and at take-up speeds of 1200 and 2000 MPM. These conjugate filaments did not crimp or contract when removed from the take-up roll. Substituting ASPUN® 681 1A polyethylene for the polypropylene component also gave no crimp development. This lack of crimp and elastic attributes was observed in filaments of a 70% Estane® 58213 polyurethane/30% polyethylene component combination melt attenuated at 2000 MPM. These same deficiencies were also encountered for 50% and 70% components of Dow's Pellethane® 2103- 80PF (L96105 polyurethane) in combination with either type of polyolefin spun at 1000 and 2000 MPM. Table 7 lists the melt attenuation conditions and provides the crimp and contraction results for these conjugate filaments.

TABLE 7

Crimp and Band Contraction With Polyurethane Elastomeric Component

| Sample | Total GHM | Take-up Speed, MPM | Crimps/ Inch | % Contraction |
|---|---|---|---|---|
| A. 70% Estane ® 58213/ 30% PE | 0.75 | 20000 | 8 | |
| B. 70% Estane ® 58887/ | 0.75 | 1200 | 0 | 0 |
| 30% PP | 0.2 | 2000 | 0 | 0 |
| C. 50% Pellethane ®/ | 0.75 | 1000 | 0 | −17 (expands) |
| 50% PP | 0.75 | 2000 | 0 | −13 (expands) |
| 70% Pellethane ®/ | 0.75 | 1000 | 0 | −15 (expands) |
| 30% PP | 0.75 | 2000 | 0 | −10 (expands) |

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means plus function claims are intended to cover the structures described herein as performing the recited function and not only structural equivalents but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

It should further be noted that any patents, applications or publications referred to herein are incorporated by reference in their entirety.

What is claimed is:

1. A method of making a seamless tubular band comprising:

extruding first molten polymeric components and second molten polymeric components and forming molten multicomponent filaments wherein the first and second components are substantially consistently positioned in distinct zones across the cross-section of the molten multicomponent filament, said first component comprising a polyolefin and said second polymeric component comprising a non-urethane elastomeric block copolymer;

attenuating the molten multicomponent filaments by applying an attenuating force to the molten multicomponent filaments as they solidify;

wrapping said filaments around a support structure to form a seamless tubular band while maintaining the attenuating force; and then removing said tubular band from said support structure and releasing said attenuating force wherein solidified multicomponent filaments contract and self-crimp.

2. The method of claim 1 wherein said attenuating force is selected from the group consisting of aspirating air and mechanical attenuation.

3. The method of claim 1 wherein said second polymeric component comprises a copolyester.

4. The method of claim 1 wherein said second polymeric component comprises a polyamide polyether block copolymer.

5. The method of claim 1 wherein said attenuating force is aspirating air.

6. The method of claim 1 wherein said second polymeric component comprises an A-B or A-B-A' block copolymer wherein A and A' are each a thermoplastic polymer end-block which contains a styrenic moiety and wherein B is an elastic polymer mid-block.

7. The method of claim 1 wherein said second polymeric component is an A-B-A' or A-B block copolymer selected from the group consisting of copoly(styrene/ethylene-butylene), styrene-poly(ethylene-butylene)-styrene, polystyrene/poly(ethylene-butylene)/polystyrene, polystyrene/poly(ethylene-butylene)/polystyrene and poly (styrene/ethylene-butylene/styrene).

8. The method of claim 7 wherein said second polymeric component further comprises a polyolefin.

9. The method of claim 7 wherein said second component comprises a blend of an elastomeric block copolymer and a polyolefin wherein said elastomeric block copolymer comprises between about 50% and about 90% by weight of said second polymeric component.

10. The method of claim 9 wherein said multicomponent filaments comprise bicomponent filaments having a side-by-side configuration.

11. The method of claim 1 wherein said second polymeric component comprises a block copolymer having a first thermoplastic polymer component and a second poly (ethylene-propylene) component.

12. The method of claim 1 wherein said second polymeric component comprises a tetra-block copolymer comprising styrene-poly(ethylene-propylene)-styrene-poly(ethylene-propylene).

13. The method of claim 11 wherein said second polymeric component further comprises a polyolefin.

14. The method of claim 13 wherein said multicomponent filaments comprise bicomponent filaments having a side-by-side configuration.

15. The method of claim 13 wherein said second component comprises a blend of an elastomeric block copolymer and a polyolefin wherein said elastomeric block copolymer comprises between about 50% and about 90% by weight of said second polymeric component.

16. The method of claim 1 wherein said first polymeric component has a melt-flow rate less than the melt-flow rate of said second polymeric component.

17. The method of claim 1 wherein said solidified filaments have at least 25 crimps per inch without any additional post-formation processing.

18. The method of claim 1 further comprising point bonding a portion of the solidified filaments.

* * * * *